US006498859B2

(12) United States Patent
Kuerti et al.

(10) Patent No.: US 6,498,859 B2
(45) Date of Patent: Dec. 24, 2002

(54) MICROPHONE MOUNT

(76) Inventors: Randy H. Kuerti, 320 Squire Rd., Columbia, SC (US) 29223; Gregory A. Cole, 350 Powell Rd., Apt. 513, Columbia, SC (US) 29203

( * ) Notice: Subject to any disclaimer, the term of this patent is extended or adjusted under 35 U.S.C. 154(b) by 0 days.

(21) Appl. No.: 09/941,520

(22) Filed: Aug. 29, 2001

(65) Prior Publication Data

US 2002/0168079 A1 Nov. 14, 2002

Related U.S. Application Data

(63) Continuation-in-part of application No. 09/880,454, filed on Jun. 13, 2001.

(60) Provisional application No. 60/290,090, filed on May 10, 2001.

(51) Int. Cl.[7] ..... H04R 25/00

(52) U.S. Cl. ..... 381/361; 381/362; 381/366

(58) Field of Search ..... 381/71.1, 71.6, 381/361, 362, 363

(56) References Cited

U.S. PATENT DOCUMENTS

| | | | | | |
|---|---|---|---|---|---|
| 2,983,790 | A | * | 5/1961 | Olson | 381/71.6 |
| 3,665,490 | A | * | 5/1972 | Oskar | 381/366 |
| 3,881,056 | A | | 4/1975 | Gibson et al. | 179/1 MF |
| 3,924,083 | A | | 12/1975 | Hagey | 179/149 |
| 4,396,807 | A | | 8/1983 | Brewer | 179/146 R |
| 4,495,641 | A | | 1/1985 | Vernino | 381/91 |
| 4,577,070 | A | * | 3/1986 | Shulman | 381/366 |
| 4,811,405 | A | | 3/1989 | Peiker | 381/169 |
| 4,977,600 | A | * | 12/1990 | Ziegler | 381/71.6 |
| 5,926,554 | A | * | 7/1999 | Hasenmaier | 381/91 |

* cited by examiner

*Primary Examiner*—Huyen Le
(74) *Attorney, Agent, or Firm*—McNair Law Firm, P.A.

(57) ABSTRACT

An amplified sound system wherein a microphone is maintained at a desired acoustic zone in front of a speaker for enhancing performance in receiving sound emanated from said speaker. The system comprises a speaker cabinet containing at least one speaker, a microphone mount and a microphone for receiving sound emanated from said speaker. The microphone mount has an elongated support member for supporting said microphone at a desired spacial distance in front of the speaker. The support member has a first end attached to the speaker cabinet, and a second end on which the microphone is carried so that the microphone is positioned in a desired acoustic zone for collecting sound emanated from said speaker.

14 Claims, 7 Drawing Sheets

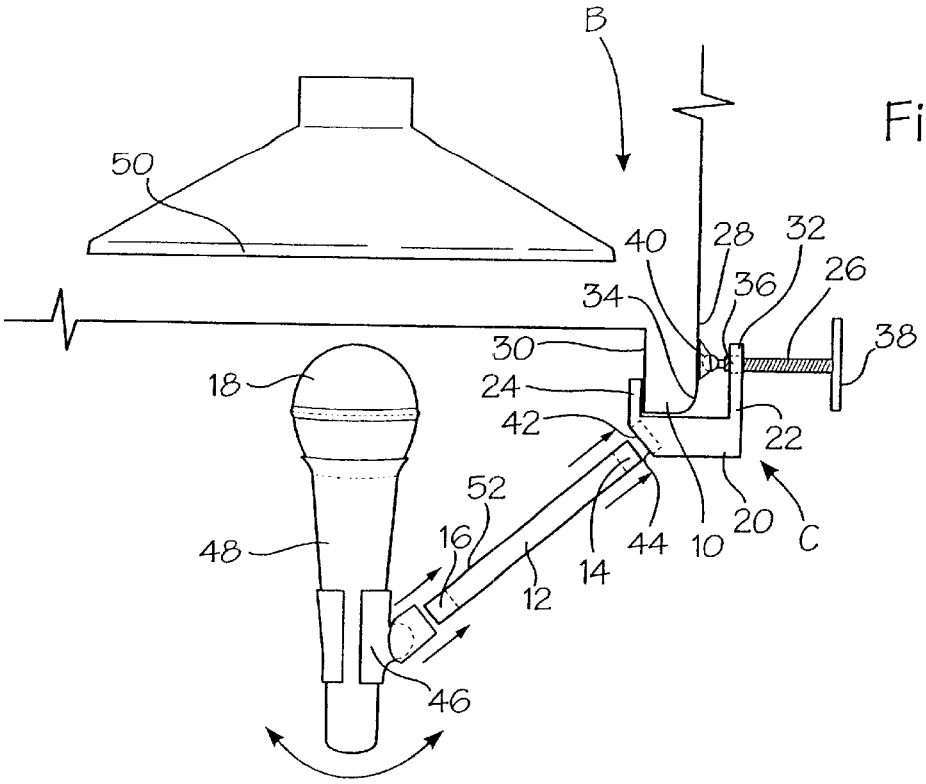
Fig. 2
Fig. 3
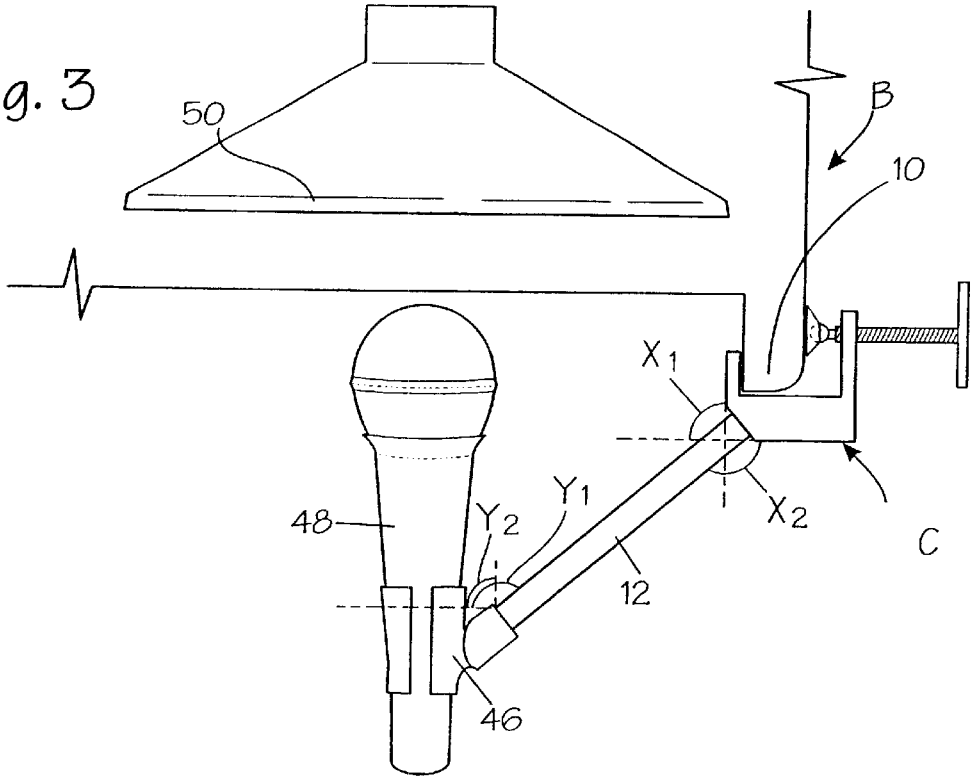

Fig. 5
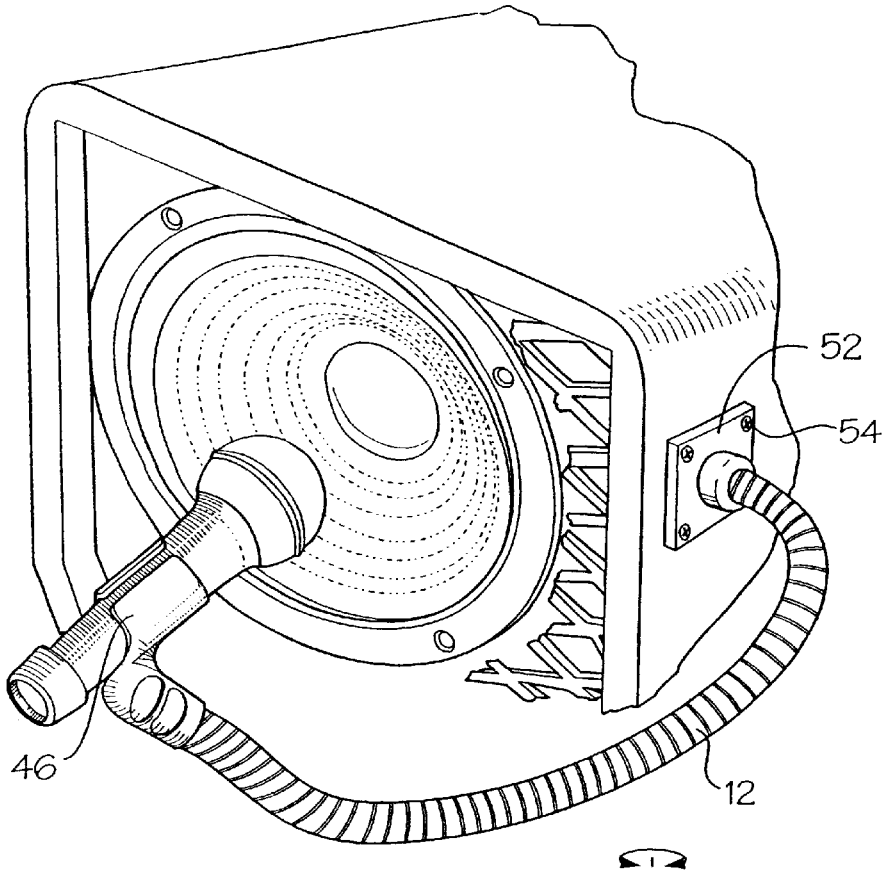
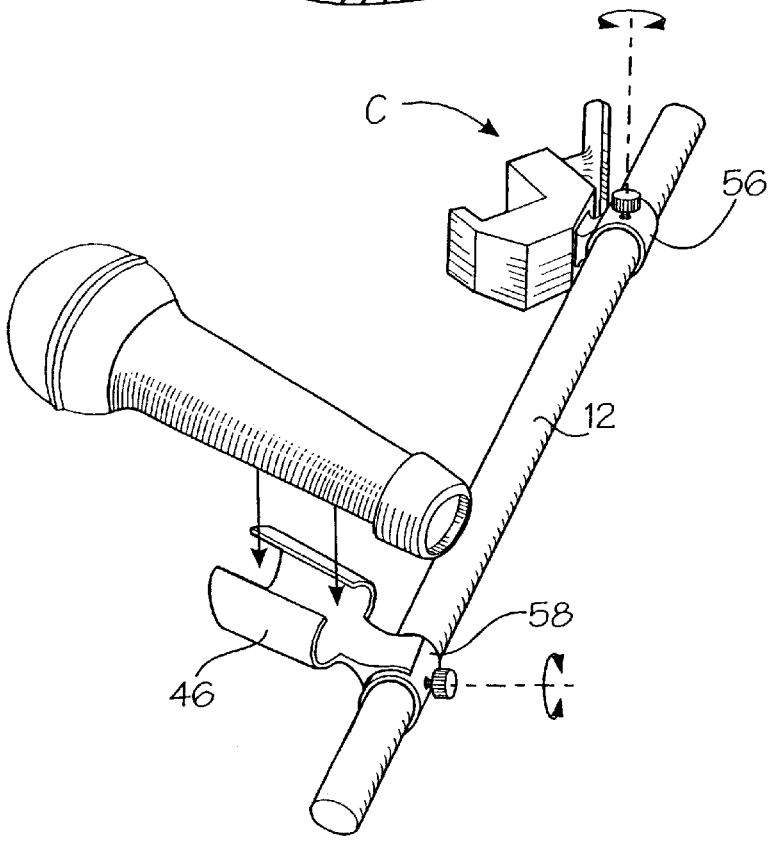
Fig. 6

MICROPHONE MOUNT

This is a continuation-in-part of Ser. No. 09/880,454 filed Jun. 13, 2001 which claims benefit of provisional Ser. No. 60/290,090 filed May 10, 2001.

FIELD OF THE INVENTION

This invention is directed to a speaker cabinet with a microphone mount, more specifically, to a mount for securing a microphone to a speaker cabinet so that the microphone is held in front of a speaker's desired acoustic zone, advantageously, to capture the optimum sound emanated from the speaker.

BACKGROUND OF THE INVENTION

Since the advent of sound amplification, musicians have been using amplifiers and speakers in order to project their performances to greater areas. The public address (P.A.) system has been instrumental in providing this functionality. Using the P.A. system for performances, a mixing board controls the audio signal inputted to the amplifiers, as well as the signals outputted to the speakers. For amplified instruments, such as electric guitars or other electric instruments, there is considerable difficulty in capturing the sound from a guitar amp to be inputted into a P.A. system. Usually, a guitar amplifier will have at least one speaker housed in a speaker cabinet which provides the audio signal originating from the electric instrument. Typically, a microphone is placed on the floor in front of the speaker in order to capture the audio signal to be inputted into the P.A. system. In order to achieve the best audio signal, the microphone must be placed in the "cube" or desired acoustic zone. The "cube" is a three dimensional area of approximately one cubic inch at a point in front of the speaker housed in the speaker cabinet.

Prior to the present invention, a microphone was placed on a short stand for amplifiers whose speakers were just inches off the floor or longer stands for higher speakers. A microphone was held, unconnected to the speaker cabinet, so the head of the mike was within the "cube." However, either movement of the stand or movement of the speaker cabinet would remove the microphone from the cube and the audio signal from the speaker would not be applicably captured. Additionally, it is typical for a performance hall or stage to have a raised floor for the performers. Vibrations ranging from the direct output of the various instruments and the P.A. tends to travel up the stand holding the microphone and create a harmonic feedback which produces a very disturbing tone. Clearly, the familiar "squeal" of a P.A. is not a desired sound. Placement of the microphone in relation to the speaker affects the sound captured. For example, the further the microphone from the sound source, the more extraneous sounds are captured. Two microphones within proximity of the same source can cause phase cancellation resulting in volume and tone levels periodically dropping when inputted to the P.A. Close proximity of the microphone to a solid surface can increase this response and "boominess" can be reduced by placement of the microphone off the axis of the speaker 90° to 45° or varying the microphone from the center of the speaker to the edge. Therefore, maintaining the placement of a microphone in front of a speaker cabinet in a predetermined location throughout a performance, to the received optimal sound from the speaker without creating harmonic resonance, is a problem for which much attention should be directed.

Accordingly, an object of this invention is to provide an amplified sound system wherein a microphone is maintained in an optimum position relative to a speaker for enhanced performance in receiving sound emanated from the speaker.

Another object of this invention is to provide a microphone mount for securing a microphone in a predetermined position relative to a speaker which is unaffected by direct acoustic vibration, or harmonic resonance that may propagate through the floor or base of a microphone stand.

Another object of this invention is to provide for a microphone mount which can consistently position a microphone in a predetermined location relative to a speaker, regardless of the number of times the microphone is attached and removed from the microphone mount or the mount removed from the speaker or speaker cabinet.

SUMMARY OF THE INVENTION

The above objectives are accomplished according to the present invention by providing an amplified sound system wherein a microphone is maintained at a desired acoustic zone in front of a speaker for enhancing performance in receiving sound emanated from a speaker. The system comprises a speaker cabinet containing at least one speaker, a microphone mount secured to the speaker cabinet, and a microphone for receiving sound emanated from the speaker. The microphone mount has a distal end positioned a desired spacial distance from the speaker. The microphone is carried by the distal end of the microphone mount so that the microphone is positioned in an optimum acoustic zone for collecting sound emanated from the speaker.

The microphone mount includes an elongated support member having a first end carried by the speaker cabinet and a second end for retaining the microphone. The microphone mount and elongated support member are constructed and arranged to provide an adjustable mount for carrying the microphone so that the microphone may be adjusted to a desired spacial distance from said speaker. In one embodiment of the invention, the elongated support member includes first and second elements which adjust longitudinally along the axis of the support member to adjustably mount the microphone to the speaker cabinet at a desired spacial distance from the speaker.

In alternative embodiment, the elongated support member includes a first arm and a second arm. The second arm is slidably carried with respect to the first arm. The second arm extends outward from within the first arm. A locking member can also be provided for locking the second arm in place so that the second arm may telescope to a desired length to accommodate different speaker sizes and make tuning adjustments to the microphone.

Additionally, the elongated support member may include at least one pivot connection carried by the elongated support member pivotally connecting the elongated support member to the speaker cabinet to adjust the position of the support member. A retaining bracket is also carried near the distal end of the elongated support member for retaining the microphone. The retaining bracket can include a swivel connector pivotally connecting the bracket to the elongated support member so that the angle and position of said mount in relation to said speaker may be adjusted to accommodate various speaker sizes and make tuning adjustments to said microphone.

Many speaker cabinets contain a plurality of speakers. A crossbar can be carried by the distal end of the elongated support member which extends horizontally across the front of a speaker cabinet. The crossbar allows for a plurality of microphone retaining brackets to be secured to the crossbar to mount a plurality of microphones in front of the speaker cabinet for a single speaker, or for each speaker contained in the speaker cabinet.

The microphone mount further includes an attachment member securing the mount to the speaker cabinet. The attachment member comprises a generally U-shaped frame with a first leg and second leg. A front rim of the speaker cabinet is received between the first and second legs. A securing member carried by one of the legs is provided for securing the U-shaped frame to the rim. The first leg has a length greater than the second leg which defines an extended portion greater than the length of the second leg and extends generally parallel to the rim of the speaker cabinet. The extended portion carries the securing member. An opening is defined within the extended portion of the first leg for receiving the securing member. The securing member including an operator being operable between a first secured position and a second unsecured position so that the attachment member may be removably secured to the rim of the speaker cabinet and repositioned at any desired location on the rim of the speaker cabinet.

The U-shaped frame further includes an angled surface disposed on the outer edge of the frame. The microphone mount is carried by the angled surface.

In an alternative embodiment, the attachment member comprises a plate with several holes for receiving securing members allowing the plate to be affixed to speaker cabinet.

Additionally, an alternative method of attaching the microphone mount to the speaker cabinet uses a securing bracket to receive and hold the attachment member. In this embodiment, the securing bracket is mounted to the side of the speaker cabinet. The securing bracket has a receiving slot on the side of the speaker cabinet for receiving the attachment member. The slot is formed between the outside of the speaker cabinet and the inside of the securing bracket. The first leg of the attachment member is inserted into the slot to attach the microphone mount.

In an alternative embodiment for the securing bracket, the securing bracket is formed with an open T-slot for receiving a male engaging member carried by the distal end of a leg on the attachment member. The securing bracket is secured to the side of the speaker cabinet with the T-slot open to the outside of the speaker cabinet. The male engaging member slides down into the T-slot to holds the microphone mount in the desired position.

The present invention also provides a method for positioning and securing a microphone at a desired acoustic zone in front of a speaker for enhancing performance in receiving sound emanated from the speaker. The method comprises the steps of positioning a speaker cabinet with at least one speaker at a desired location, placing a microphone in the retaining bracket of the microphone mount, selecting the placement of the microphone on the speaker cabinet so that the microphone is positioned at the desired acoustic zone of the speaker and secured in this position for collecting sound emanated from said speaker. The microphone mount is secured in the selected position by turning the securing member which tightens the mount to the speaker cabinet so that the position of the microphone becomes fixed and maintained at the desired acoustic zone in front of the speaker, even when the speaker cabinet is repositioned or knocked out of place.

Also, multiple microphone mounts can be attached to secure additional microphones to the speaker cabinet. In certain instances, multiple microphones may be used to collect sound from a single speaker, or multiple microphones can be sued to collect sound from a speaker cabinet with multiple speakers.

In one of the alternative embodiments, the support member may be telescoped to an appropriate length for a given speaker size to accurately adjust the position of the microphone to the desired acoustic zone of the speaker. Also, the angle of the support member and engaging member can be adjusted in relation to the face of the speaker to accurately position the microphone within the desired acoustic zone for various speaker sizes or tune the microphone for a desired sound.

DESCRIPTION OF THE DRAWINGS

The invention will be more readily understood from a reading of the following specification and by reference to the accompanying drawings forming a part thereof, wherein an example of the invention is shown and wherein:

FIG. 2 is a top plain view of the microphone mount attached to the rim of a speaker cabinet;

FIG. 3 is a top plain view of the microphone mount showing various angles of the elements of the mount;

FIG. 5 shows an alternative embodiment of the microphone mount with an adjustable elongated support member according to the invention;

FIG. 6 shows an alternative embodiment of the microphone mount wherein the mount is attached along the longitudinal axis of the elongated support member according to the invention;

DESCRIPTION OF A PREFERRED EMBODIMENT

Figure 1:
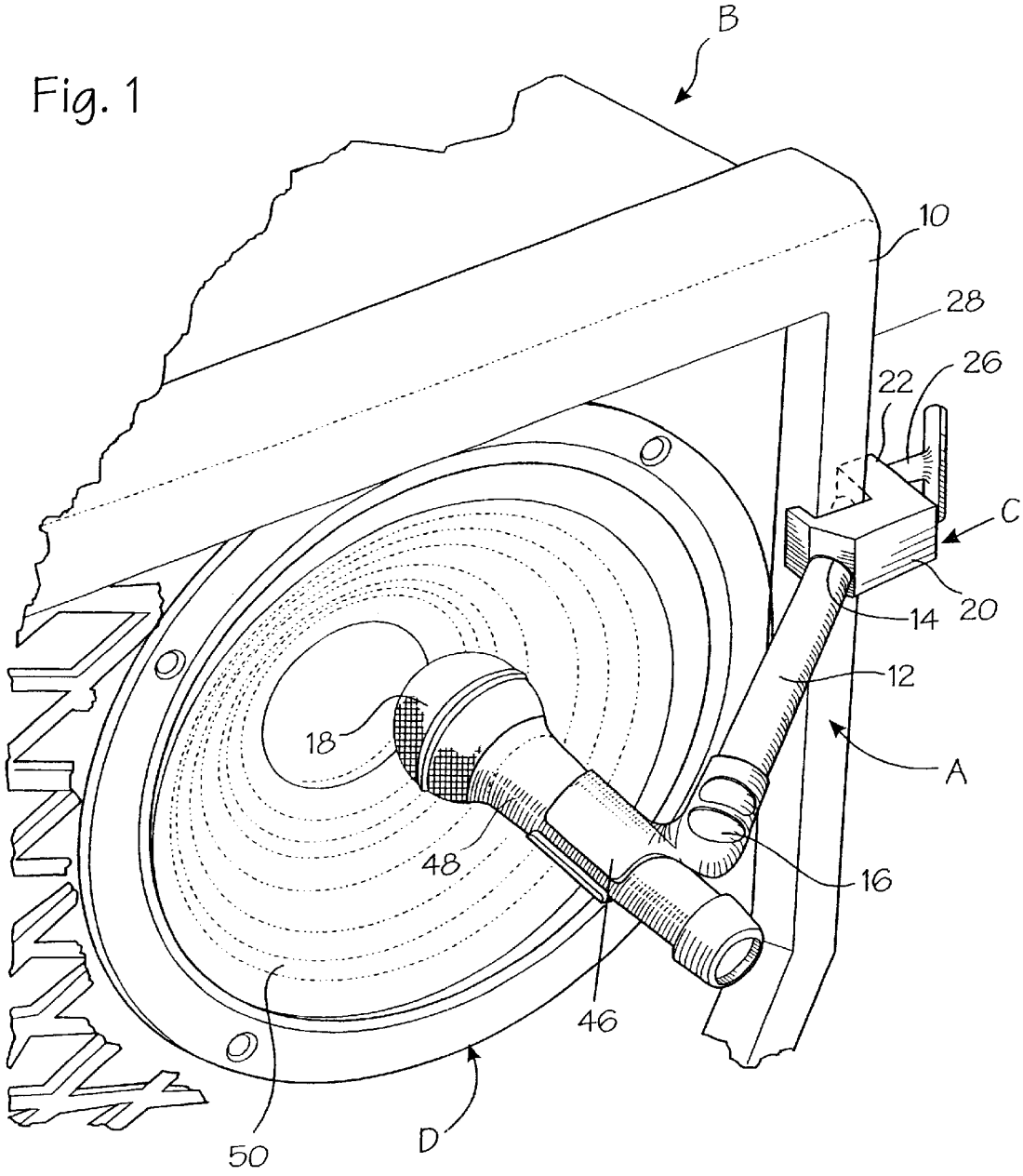
FIG. 1 is a perspective view of the microphone mount attached to a speaker cabinet.

Referring now to the drawings, the invention will be described in more detail. Referring to FIGS. 1 and 2, the preferred embodiment of the microphone mount, shown generally as A, is shown attached to a rim 10 of a speaker cabinet B. Microphone mount A comprises an elongated support member 12 with a first end 14 affixed to the speaker cabinet B and a second distal end 16 carrying a microphone 18 at a desired acoustic zone for receiving sound emanated from a speaker D.

Typically, a speaker cabinet has rim 10 which surrounds the front of the speaker cabinet on which the microphone mount may be attached. In the preferred embodiment, microphone mount A has an attachment member C which affixes the first end 14 of the elongated support member to the rim of the speaker cabinet. The attachment member is generally a U-shaped frame 20, having a first leg 22 and a second leg 24. The rim 10 of the speaker cabinet is received between the first and second legs. The first leg 22 extends along the outer edge 28 of the speaker cabinet rim 10. The second leg 24 extends along the inner surface 30 of the speaker cabinet rim. In the preferred embodiment, as best seen in FIG. 2, the first leg has a length greater than the length of the second leg which defines an extended portion 32 extending generally parallel to the rim of the speaker cabinet and past the length of the second leg 24. An opening 36 is defined within the extended portion of first leg 22 for receiving a securing member 26. The opening and securing member are threaded to allow the securing member to operate between a first secured position and a second unsecured position in which the microphone mount may be removed. The securing member 26 is carried by this extended portion perpendicular to the outer edge of the speaker cabinet rim for securing the U-shaped frame to the rim of the speaker cabinet. The extended portion 32 of the U-shaped frame 20 allows the securing member to contact the outer edge 28 of the speaker cabinet rim beyond any beveled edging 34, commonly found on speaker cabinets, for which the microphone mount is intended to be used.

In the preferred embodiment, securing member 26 comprises a threaded rod received by reciprocating threading within opening 36. A handle 38 is attached at a first end of rod for turning the rod and a contact disk 40 is attached at the second end of the rod for contacting the speaker cabinet. By turning handle 38, securing member 26 is forced to press disk 40 against the speaker cabinet and second leg 24 of the U-shaped frame 20 is thereby tightened against inner surface 30 of the speaker cabinet rim 10, securing microphone mount A in the desired position on the rim of the speaker cabinet.

The U-shaped frame can include an angled surface 42 disposed on the outer edge of the frame for carrying elongated support member 12.

In an alternative embodiment shown in FIG. 5, the attachment member comprises a plate 52 with several holes 54 for receiving securing members allowing the plate to be affixed to speaker cabinet. The securing members include such common members as screws, bolts, nails, or other such securing members. The plate could also be attached to the speaker cabinet by using glue, hook and loop connectors, or other common adhesives.

Figure 7:
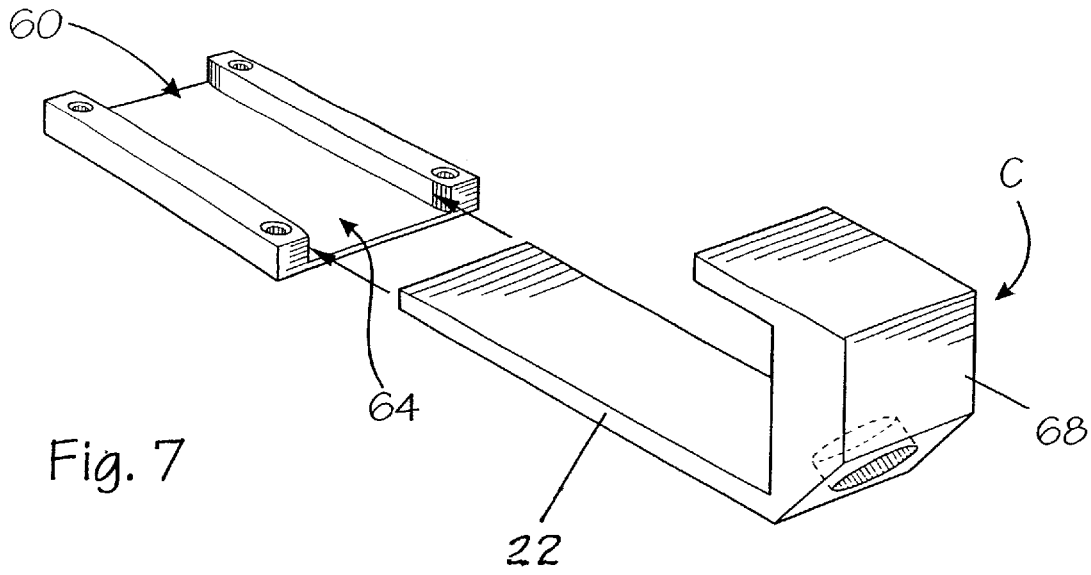
FIG. 7 shows an alternative embodiment of the microphone mount using a securing bracket to attach the mount to the speaker cabinet according to the invention.
Figure 8:
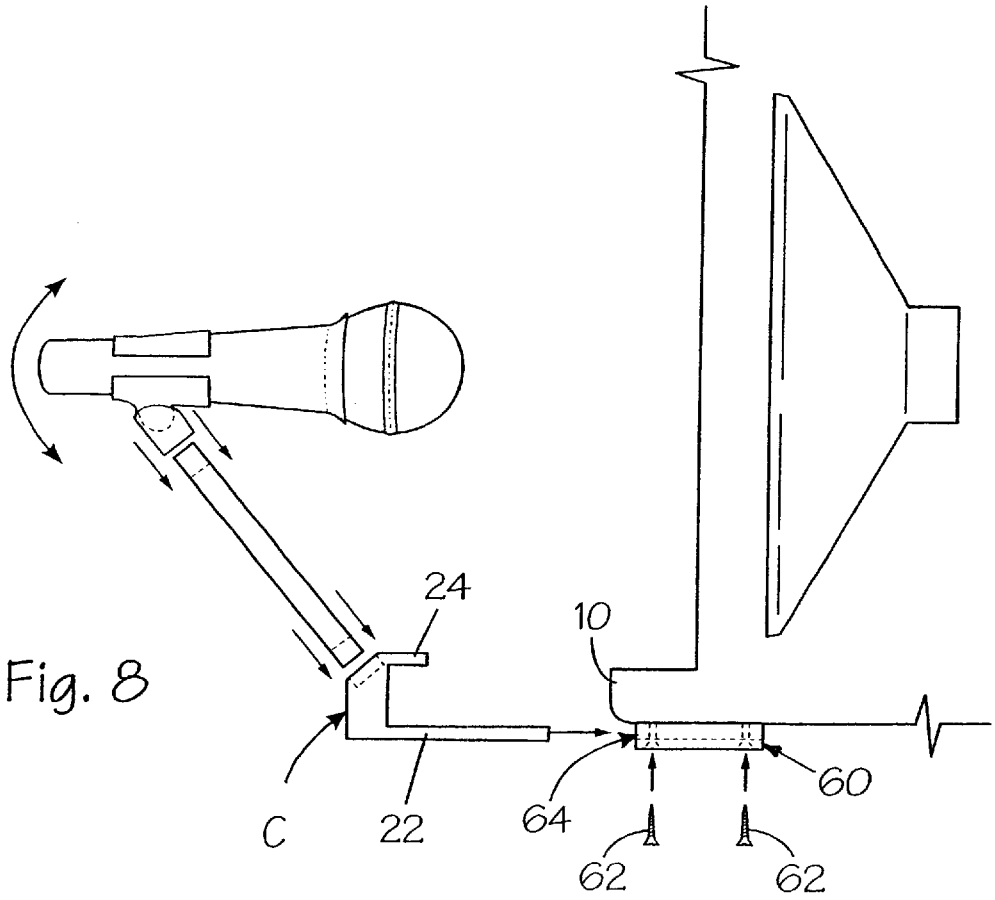
FIG. 8 shows a top plain view of the securing bracket attached to the speaker cabinet according to the invention.

Referring to FIGS. 7 and 8, an alternative arrangement of attaching the microphone mount to the speaker cabinet uses a securing bracket 60 to receive and hold attachment member C. In this embodiment, securing bracket 60 is mounted to a side of the speaker cabinet near the edge of rim 10 by screws, bolts, nails, or other such common securing members 62. Securing bracket 60 is a generally U-shaped bracket that creates a slot 64 on the side of the speaker cabinet for receiving a first leg 22 of attachment member C. The slot is formed between the outside of the speaker cabinet and the inner surface of securing bracket 60. First leg 22 of the attachment member inserts into slot 64 to secure the microphone mount to the speaker cabinet. The need for securing member 26 and second leg 24, shown best in FIG. 2, is eliminated with this design since securing bracket 60 sufficiently supports the weight of the microphone mount and maintains it in position. Thus, attachment member C can be formed with a generally L-shaped frame having a first leg 22 extending generally parallel to the side of the speaker cabinet to be received within the slot, and extension 68 extending only perpendicular of first leg 22. In position, extension 68 rests against the front of rim 10.

Figure 9:
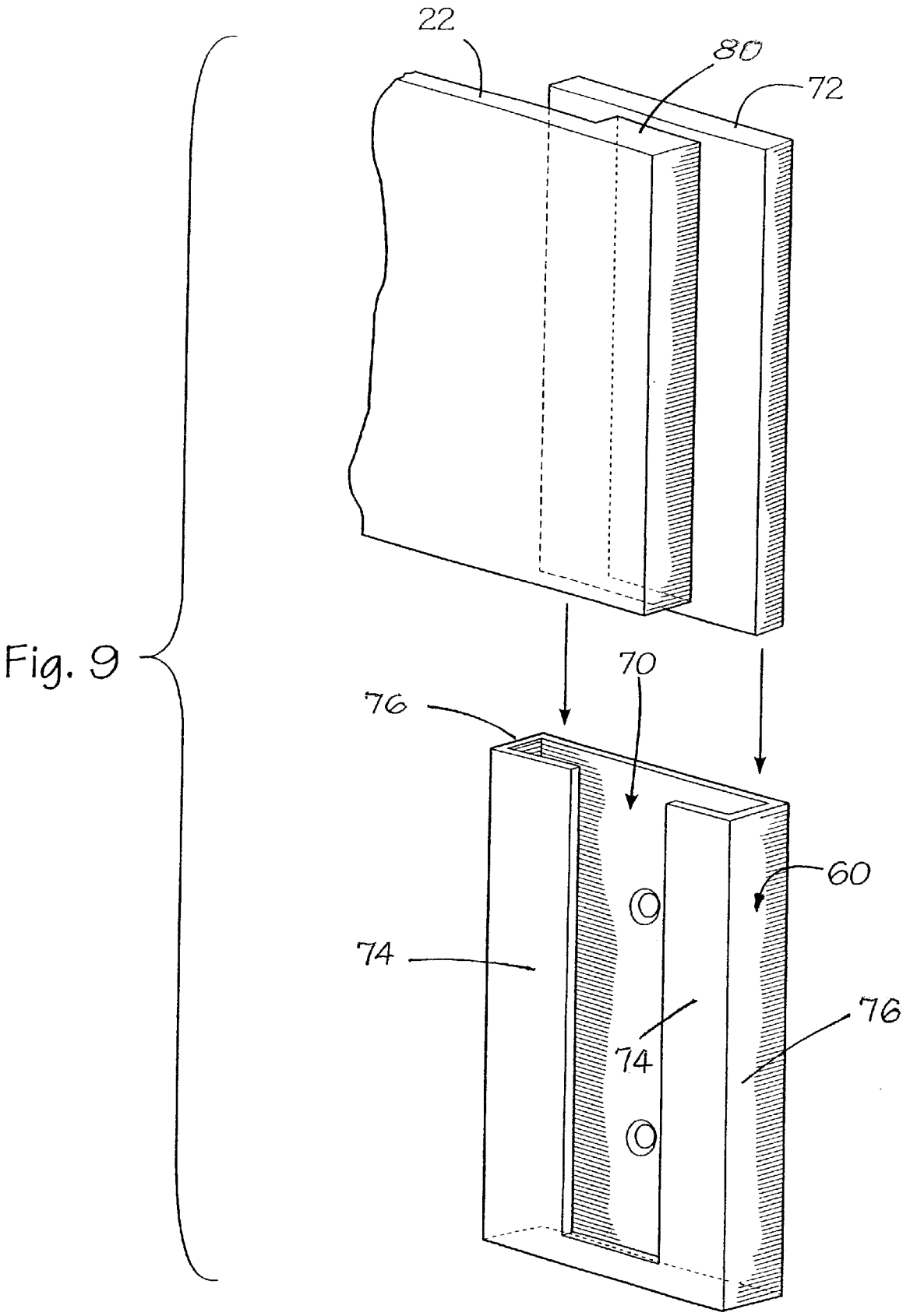
FIG. 9 shows an alternative embodiment of the securing bracket that uses a T-slot to receive and secure the attachment member of the microphone mount according to the invention; and, FIG. 10 shows an alternative embodiment of the microphone mount including a crossbar carrying a plurality or retaining brackets according to the invention.

Referring to FIG. 9, in another embodiment includes a securing bracket 60 formed with an open T-slot 70 for receiving an engaging element 72 carried by the distal end of first leg 22 on attachment member C. The securing bracket includes a pair of spaced parallel outer surfaces 74 carried by side members 76 and bottom member, which form the open T-slot. The securing bracket is secured to the side of the speaker cabinet with the T-slot open to the outside of the speaker cabinet. The securing bracket is attached by using screws, bolts, nails, or other such common securing members. The engaging element slides down into the T-slot to hold the microphone mount in the desired position. The engaging element is formed from a rectangular member of sufficient size to solidly fit with the T-slot so that first leg 22 of attachment member C is immobilized within securing bracket 60. Engaging element 72 is fixedly attached to first leg 22 by spacer member 80. Spacer member 80 extends through T-slot 70 of the securing bracket to attach to first leg 22. The spacer member must be of a sufficient thickness to allow the rectangular member to be received with the T-slot while allowing first leg 22 to pass along the outer surface 74.

Elongated support member 12 comprises a bar of a sufficient length to space the distal end 16 carrying microphone 18 at a desired acoustic zone for receiving sound emanated from a speaker D. In the preferred embodiment, elongated support member 12 is carried by the attachment member, however, speaker cabinet B can be adapted to directly carry the elongated support member without the need for attachment member C. Alternatively, as shown in FIG. 5, elongated support member 12 can be formed from an adjustable coiled rod, common in the art for supporting microphones, which would allow the elongated support member to bend and position microphone 18 at a desired distance from the speaker.

Depending on the amount of adjustability desired in the microphone mount, the first end 14 of elongated support member 12 may either be fixedly or adjustably attached to the attachment member. Alternatively, elongated support member 12 may also be fixed or adjustably attached to the speaker cabinet without using the attachment member by securing the first end 14 of the elongated support member directly to speaker cabinet B. In one embodiment, as shown in FIG. 3, the first end of the elongated support member is fixedly attached to the U-shaped frame at a predetermined angle for a specific speaker size. The first end 14 of support member 12 is inserted into a cavity 44 formed into the angled surface 42 on outer edge of U-shaped frame 20, thereby fixing the position of the elongated support member at a predetermined angle in relation to the face of speaker 50. Cavity 44 could alternatively be formed into the speaker cabinet itself, allowing first end 14 of elongated support member 12 to directly attach to the speaker cabinet.

Also, in an alternative embodiment, first end 14 of elongated support member 12 can be made adjustably attached to the U-shaped frame, or directly to the speaker cabinet, by a pivot connector. This allows the angle of the support member to be adjusted in relation to the face of the speaker to make tuning adjustments to the microphone and accommodate different speaker sizes. Support member 12 can be adjustably attached to the speaker cabinet or attachment member by any appropriate pivot connector such as ball and socket joint, hinge, or other common pivot connectors which will change the angle of the support member in relation to the face of speaker 50.

Distal end 16 of elongated support member 12 carries microphone 18 at a desired spacial distance from the front of the face of speaker 50. To support the microphone at the distal end of the elongated support member is a retaining bracket 46. The retaining bracket is carried by the distal end of the support member and is adapted for receiving and retaining shaft 48 of a microphone by encompassing the shaft and holding the microphone in place by a friction fit. In the present invention, retaining bracket 46 will hold the microphone in position in front of the speaker in the optimum acoustic zone for collecting sound emanated from the speaker. Additionally, a crossbar 59 can be affixed to the distal end 16 of elongated support member 12. This allows for retaining brackets to be affixed to both ends of the crossbar which could then be used to position at least two microphones in front of a speaker cabinet having a plurality of speakers. As described below, additional retaining brackets could be placed along the longitudinal axis of the crossbar to mount a plurality of microphones.

Additionally, in an alternative embodiment, retaining bracket 46 may be made adjustably attached to elongated support member 12 by an appropriate pivot connector, such as ball and socket joint, hinge, or other common pivot connector which will change the angle of retaining bracket 46 in relation to the face of speaker 50. This embodiment allows the microphone mount to change the angle of the microphone to accommodate various speaker size and make minor tuning adjustments to better position the microphone within the optimal acoustic zone for collecting sound emanated from the speaker.

Figure 10:
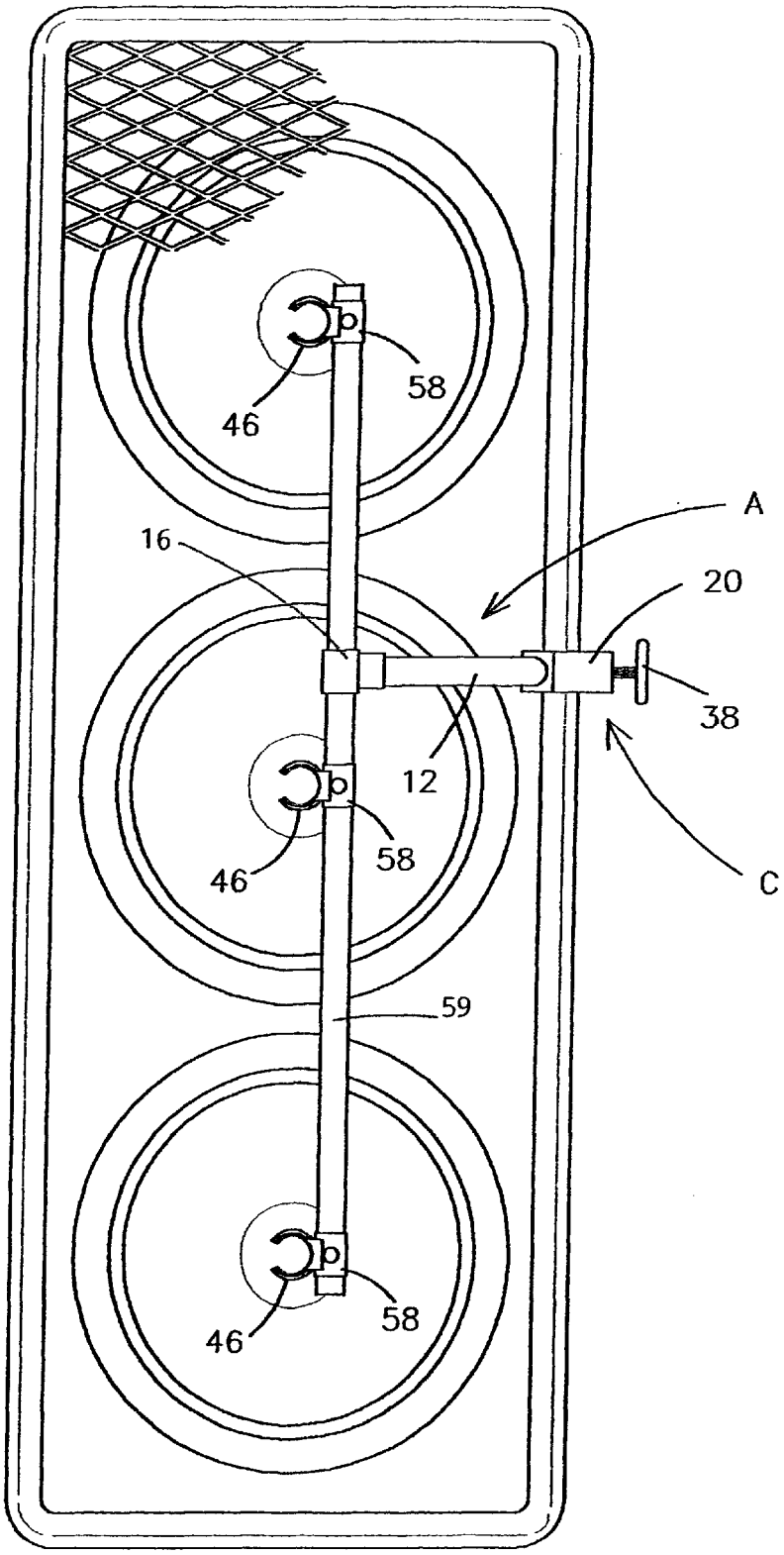

Many speaker cabinets contain a plurality of speakers, each requiring a separate microphone and mount in order to provide the best acoustic reproduction of the sound emanated from the speakers. Referring to FIG. 10, a crossbar 59, similar to elongated support member 12 shown in FIG. 6, can be carried by distal end 16 of the elongated support member and extend horizontally across the front of a speaker cabinet. The crossbar allows for a plurality of microphone retaining brackets 46 to be secured 58 along the longitudinal axis of the crossbar to mount a plurality of microphones in front of the speaker cabinet for a single speaker, or for each speaker contained in the speaker cabinet.

Referring to FIG. 6, in an alternative embodiment, both the attachment member and microphone retaining bracket 46 can be adjustably attached along the longitudinal axis of elongated support member 12 by first and second elements respectively. The first element 56, which carries the attachment member, and second element 58, which carries the retaining bracket, are slidable about the length of elongated support member 12 and are operable between secured and unsecured positions to allow for adjustment along the entire longitudinal axis of the elongated support member. The first and second elements may be comprised of a clamp, bracket, or other fastening member which is capable of attachment along the longitudinal axis of the elongated support member.

Figure 4A:
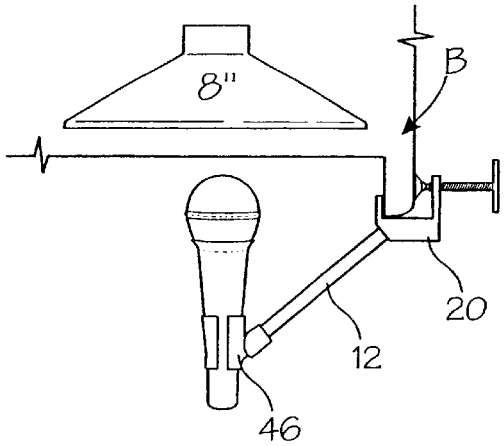
FIGS. 4*a,* 4*b,* and 4*c,* are views of the microphone mount attached to the rim of speaker cabinets with different size speakers.
Figure 4B:
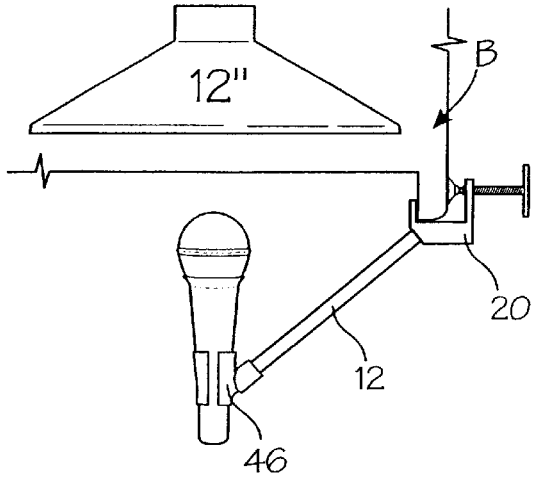
Figure 4C:
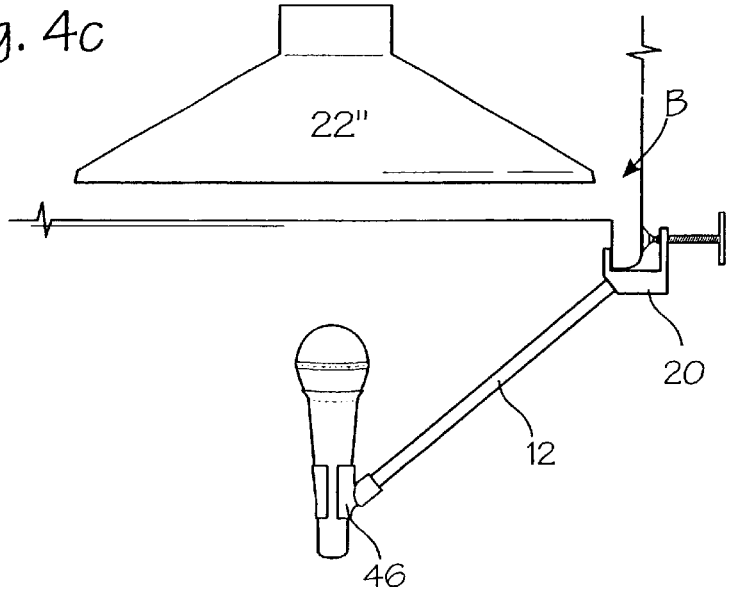

As best shown in FIGS. 4*a,* 4*b,* and 4*c,* elongated support member 12 can also be made a predetermined length for a predetermined angle and specific speaker size to accurately position microphone 18 at the desired spacial location in front of the speaker. In this embodiment, retaining bracket 46 can be either adjustably or fixedly attached to elongated support member 12 by an appropriate pivot connectors as disclosed above, depending on the amount of adjustability desired in the microphone mount.

Alternatively, elongated support member 12 can be made to telescope to various lengths to accommodate various speaker sizes, making the microphone mount more adaptable, but requiring the user to properly mount the microphone to find the optimal acoustic zone for collecting sound emanated from the speaker. The telescoping embodiment is accomplished by having an elongated support member with a first arm and a second arm. The first arm having a diameter slightly greater than that of the second arm so that the second arm may be slidably carried with respect to the first arm. The second arm may then be extended outward from within the first arm to a desired position. The arms are slidable about each other and can be locked at any degree of extension therefrom by a locking device, shown diagrammatically in the drawing as a locking button 52, but representing any desired locking member for two telescoping arms. Such locking members can include a positive lock (pin and hole device), a friction lock (such as a wedge device), or some other friction clamp arrangement. This allows the support member to telescope to various lengths and accommodate different sizes of speakers.

As an example of the preferred embodiment for positioning a microphone in the desired acoustic zone of a 12" speaker, the microphone mount would have a support member 20 with a length of five inches at an angle of forty-two degrees in relation to the face of speaker 50. Retaining bracket 46 will hold the axis of the microphone at a generally perpendicular angle to the face of the speaker and be horizontal to the floor. However, these angles vary with the size of the speaker. FIG. 3 shows the angle of the support member as $X_1$ and $X_2$. $X_2$ can range from any angle between 0 and 180 degrees. $Y_1$ and $Y_2$ represents the angle of the retaining bracket to the elongated support member. $Y_1$ can also range from any angle between 0 and 180 degrees in order to accommodate for the proper placement of the microphone in the desired position. In the preferred embodiment, $X_2$ and $Y_1$ are formed at an angle of 135 degrees.

The method of attaching microphone mount A comprises the steps of first positioning a speaker cabinet B with at least one speaker at a desired location. Next, a microphone 18 is placed in retaining bracket 46 of the microphone mount. The user selects the placement of the microphone on the speaker cabinet so that the microphone is positioned within the desired acoustic zone in front of the speaker for collecting sound emanated from the speaker. The microphone mount is secured in the selected position by turning securing member 26 which tightens the microphone mount to rim 10 of the speaker cabinet so that the position of the microphone becomes fixed and maintained at a desired position even when the speaker cabinet is repositioned or knocked out of place. Also, multiple microphone mounts can be attached to secure additional microphones or as many speakers as are contained within the speaker cabinet.

In one of the alternative embodiments, support member 12 may be telescoped and locked at an appropriate length to accurately adjust the position of the microphone in front of the speaker. Also, in an alternative embodiment, the angle of support member 12 and retaining bracket 46 can be adjusted in relation to speaker to accurately position the microphone within the optimal acoustic zone for collecting sound emanated from the speaker for various speaker sizes, or to tune the microphone to a desired sound.

While a preferred embodiment of the invention has been described using specific terms, such description is for illustrative purposes only, and it is to be understood that changes and variations may be made without departing from the spirit or scope of the following claims.

What is claimed is:

1. An amplified sound system having a microphone mount assembly for maintaining a microphone within a desired acoustic zone in front of a speaker housed in a speaker cabinet, said system comprising:

a speaker cabinet containing at least one said speaker;

a detachable interconnecting mount mounting said microphone to said speaker cabinet including;

a mounting bracket affixed to said speaker cabinet included in said mount assembly;

an elongated support, included in said mount assembly, of sufficient length to position the microphone within said acoustic zone;

a detachable attachment member carried by a first end of said elongated support which interconnects with said mounting bracket for detachably securing said elongated support to said speaker cabinet;

said attachment member including a generally L-shaped frame with a first leg extending along the side of said speaker cabinet to interconnect with said mounting bracket, and a second extension of said frame extending perpendicular from said first leg to rest against the front of said speaker cabinet so that said microphone mount is secured to said speaker cabinet;

said mounting bracket including a slot for receiving said attachment member so that said elongated support is interconnected with said mounting bracket for detachably securing said microphone mount to said speaker cabinet; and a microphone retaining bracket carried by a second distal end of said elongated support for holding said microphone within said acoustic zone so that accurate sound amplification and enhanced performance is provided in receiving sound emanated from said speaker.

2. The microphone mount of claim 1 wherein said mounting bracket comprises a generally U-shaped bracket; said slot being formed between the outer surface of said speaker cabinet and adjacent surface of said mounting bracket.

3. The microphone mount of claim 1 wherein said mounting bracket including a pair of spaced parallel outer surfaces carried by side members and an adjoining bottom member which form a T-slot for receiving said attachment member.

4. The microphone mount of claim 3 wherein said attachment member includes an engaging element to be received within said T-slot of said mounting bracket; said engaging element comprises a rectangular member disposed near the end of said leg of said attachment member for interconnecting with said mounting bracket; a spacer member connects said rectangular member to said attachment member by extending between said spaced parallel outer surfaces of said mounting bracket so that said rectangular member slides entirely within said T-slot.

5. The microphone mount of claim 1 wherein said attachment member includes an engaging element to be received within said slot of said mounting bracket.

6. The microphone mount of claim 5 wherein said engaging element comprises a leg that extends from said attachment member along the side of said speaker cabinet for interconnecting with said mounting bracket.

7. The microphone mount of claim 1 including a crossbar carried at said distal end of said elongated support; said crossbar having a plurality of retaining brackets for holding a plurality of microphones in spaced horizontal alignment.

8. In an amplified sound system having a microphone mount assembly for maintaining a microphone within a desired acoustic zone in front of a speaker housed in a speaker cabinet, said system comprising:

said mount assembly including a mounting bracket affixed to said speaker cabinet;

an elongated support, included in said mount assembly, of sufficient length to position the microphone within said acoustic zone;

said elongated support including an attachment member which interconnects with said mounting bracket for detachably securing said elongated support with said mounting bracket and said speaker cabinet;

said mounting bracket including a slot for receiving said attachment member so that said elongated support is interconnected with said mounting bracket for detachably securing said microphone mount to said speaker cabinet;

said attachment member including a generally u-shaped frame with a first leg and second leg; a front rim of said speaker cabinet having a portion received between said first and second legs; and, one of said legs extending along the side of said speaker cabinet to interconnect with said mounting bracket so that said microphone mount is secured to said speaker cabinet; and a microphone retaining bracket carried by a distal end of said elongated support for holding said microphone within said acoustic zone so that accurate sound amplification and enhanced performance is provided in receiving sound emanated from said speaker.

9. The microphone mount of claim 8 wherein said mounting bracket comprises a generally U-shaped bracket; said slot being formed between the outer surface of said speaker cabinet and adjacent surface of said mounting bracket.

10. The microphone mount of claim 8 wherein said mounting bracket including a pair of spaced parallel outer surfaces carried by side members and an adjoining bottom member which form a T-slot for receiving said attachment member.

11. The microphone mount of claim 10 wherein said attachment member includes an engaging element to be received within said T-slot of said mounting bracket; said engaging element comprises a rectangular member disposed near the end of said leg of said attachment member for interconnecting with said mounting bracket; a spacer member connects said rectangular member to said attachment member by extending between said spaced parallel outer surfaces of said mounting bracket so that said rectangular member slides entirely within said T-slot.

12. The microphone mount of claim 8 wherein said attachment member includes an engaging element to be received within said slot of said mounting bracket.

13. The microphone mount of claim 12 wherein said engaging element comprises a leg that extends from said attachment member along the side of said speaker cabinet for interconnecting with said mounting bracket.

14. The microphone mount of claim 8 including a crossbar carried at said distal end of said elongated support; said crossbar having a plurality of retaining brackets for holding a plurality of microphones in spaced horizontal alignment.

* * * * *